US006782112B1

(12) United States Patent
Geddes

(10) Patent No.: US 6,782,112 B1
(45) Date of Patent: Aug. 24, 2004

(54) LOW FREQUENCY TRANSDUCER ENCLOSURE

(76) Inventor: Earl R. Geddes, 43516 Scenic La., Northville, MI (US) 48167

( * ) Notice: Subject to any disclaimer, the term of this patent is extended or adjusted under 35 U.S.C. 154(b) by 0 days.

(21) Appl. No.: 09/508,790

(22) PCT Filed: Oct. 1, 1998

(86) PCT No.: PCT/US98/20817

§ 371 (c)(1),
(2), (4) Date: Mar. 16, 2000

(87) PCT Pub. No.: WO99/18755

PCT Pub. Date: Apr. 15, 1999

Related U.S. Application Data

(60) Provisional application No. 60/060,546, filed on Oct. 2, 1997.

(51) Int. Cl.[7] ..... H04R 25/00

(52) U.S. Cl. ..... 381/351; 381/345; 381/186; 381/349; 381/353; 181/145; 181/163

(58) Field of Search ..... 381/89, 182, 184, 381/186, 345, 346, 347, 348, 349, 350, 351, 353, 335; 181/144, 145, 147, 163, 166, 155, 156

(56) References Cited

U.S. PATENT DOCUMENTS

| | | | | | |
|---|---|---|---|---|---|
| 3,805,514 | A | * | 4/1974 | Bodine | 60/698 |
| 4,076,097 | A | | 2/1978 | Clarke | |
| 4,182,937 | A | * | 1/1980 | Greenwood | 381/162 |
| 4,301,332 | A | | 11/1981 | Dusanek | |
| 4,379,951 | A | * | 4/1983 | Gabr | 381/186 |
| 4,547,631 | A | | 10/1985 | Nieuwendijk et al. | |
| 5,327,504 | A | * | 7/1994 | Hobelsberger | 381/350 |
| 5,812,686 | A | * | 9/1998 | Hobelsberger | 381/345 |
| 5,850,460 | A | * | 12/1998 | Tanaka et al. | 381/186 |

* cited by examiner

*Primary Examiner*—Suhan Ni

(57) ABSTRACT

An acoustical transducer enclosure has an acoustic lever acoustically coupled to an electro-acoustical transducer so as to force all radiated sound through the lever.

8 Claims, 9 Drawing Sheets

Fig. 1 - *Prior Art*

Fig. 2 - *Prior Art*

LOW FREQUENCY TRANSDUCER ENCLOSURE

This application claims the benefit of Provisional application No. 60/060,546 filed Oct. 2, 1997.

BACKGROUND

1. Field of the Invention

The present invention relates to acoustical transducer enclosure methodologies and ways to improve their efficiency.

2. Description of Prior Art

Transducer enclosure design for audio loudspeaker reproduction is a highly evolved science. The art of these designs goes back nearly one hundred years and yet there have been numerous recent advances in this art. The basic design methodologies are well described in the classical works of Novak "Performance of Enclosures for Low Resonance High Compliance Loudspeakers", Thiele "Loudspeakers in Vented Boxes" Parts I and II, Small "Vented-Box Loudspeaker Systems" Parts I, II, III, and IV, and Geddes "An Introduction to Bandpass Loudspeaker Enclosures". All of these articles can be found in the Loudspeaker Anthology series available from the Audio Engineering Society, New York, N.Y. A combined reference to these works would encompasses most of the current state-of-the-art in commercial loudspeaker enclosure design.

The recent trend towards the bandpass type of enclosure stems from the desire to produce more output with less energy i.e.—improved efficiency. By tuning single or multiple resonant acoustical systems the loading presented to the loudspeaker can be increased with a corresponding increase in efficiency. A rule of thumb for these designs is that the narrower the bandwidth of the bandpass system the higher the acoustic gain and the greater the efficiency improvement. This limitation of high efficiency—low bandwidth or low efficiency—high bandwidth is sometimes stated as—the efficiency bandwidth product for a bandpass loudspeaker system must remain constant. Mathematically this is not exactly true, but practically speaking it is.

It would be highly desirable to be able to increase the acoustic load presented to the loudspeaker without a corresponding decrease in the bandwidth of the resulting system.

Other novel attempts at increasing the radiating efficiency have been attempted by such inventors as Dusanek in his 1981 patent "Woofer Loudspeaker" U.S. Pat. No. 4,301,332. In this patent the rear of a loudspeaker is attached to "an inner and an outer passive speaker cone" such that the outer radiating cone is larger than the inner cone. An example from this patent is shown in FIG. 1. A mechanical amplification of the loudspeaker cone motion is thus created. The inventor claims that this results in "a combination of lower frequency response and higher efficiency from a . . . small enclosure . . . ". The frequency response of the system may be lower, but the efficiency in the passband cannot be increased with this design. This is because the larger cone motion of the passive radiator will increase the sound radiation only in a very narrow range of frequencies around box resonance. Below this resonance the front and rear radiation will cancel one another (as in any ported enclosure) defeating any gains in radiation efficiency that might otherwise have been produced by a mechanical amplifier. Above resonance a passive radiator becomes decoupled from the loudspeaker and the pass band efficiency of the system must remain that of the direct radiator since there is no output from the passive radiator. At resonance an increase in efficiency will be evident and this improved efficiency can be utilized only by tuning the box lower than otherwise would be the case. Dusanek failed to realize that to be truly effective all of the radiating sound must be directed through the dual cone mechanical amplifier. This design has never seen commercial success.

Other forms of mechanical advantage have been tried. Niewendijk, et. al (1985) disclosed in U.S. Pat. No. 4,547,631, the use of a mechanical arm acting as a lever between a traditional voice coil and a bellows. The idea is to create a large volume displacement of the radiating surface from a much smaller motion of the voice coil or other actuating motor. The disadvantages of this design are extreme complexity in design and manufacturing and highly questionable reliability. This design has also never seen commercial implementation.

A similar (identical?) design to that of Dusanek was disclosed by Clarke in U.S. Pat. No. 4,076,097, "Augmented Passive-Radiator Loudspeaker Systems" (1979). In this invention a dual cone unit is again coupled to the back of a freely radiating driver except that the sound energy is directed to the junction between two passive radiator cones. An example from this patent is shown as FIG. 2. The inventor claims that this new design offers an improved response over a standard passive radiator design due to the possibility of controlling the net compliance of the passive radiator by the addition of the second box. This "improvement" is of little consequence since any effect of a passive radiator's compliance would take place below resonance where the acoustical output is negligible. In practice the compliance of a passive radiator is not very important—thus controlling it is of little interest. This design never saw commercialization.

Referring now to FIG. 5, transducer 70 is energized by connecting its motor to an amplifier (not shown) via wires 95. In this manner acoustic energy from the transducer is introduced into chamber 30. The sound pressure that results from this acoustic energy acts on the driven area of the lever 85, which faces the transducer. Lever 80 will be displaced by this action in an amount that is substantially equal to the ratio of the transducer radiating area to the driven area of the acoustic lever multiplied by the transducers cone displacement. That is, if $x_d$ is the displacement of a transducer having area $A_d$ and $x_1$ is the displacement of the driven surface of an acoustic lever having area $A_{ld}$ then:

$$x_1 = \frac{A_d}{S_d} \cdot x_d$$

An acoustic lever moves as a unit and thus the displacement of the radiating area of the acoustic lever is also $x_1$. The radiating area, $A_{lr}$, faces the exterior fluid medium. The volume of air displaced (displacement times area) by the radiating area of the acoustic lever, $A_{lr}$, will be:

$$A_{lr} = A_{lr} \cdot x_1 = A_{lr} \cdot \frac{A_d}{A_{ld}} \cdot x_d = \frac{A_{lr}}{A_{ld}} \cdot A_d \cdot x_d = \frac{A_{lr}}{A_{ld}} \cdot V_d$$

where $V_d$ is the volume of air displaced by the transducer. If the radiating area is greater than the driven area then the volume velocity of air radiated by the acoustic lever will be greater than that of the transducer by the ratio of the acoustic levers radiating area to its driven area. This transformation of radiating volume velocity is very similar to the function of a transformer in electrical terms or a lever in mechanical terms. Hence the name acoustic lever.

As an example of the relationship given above, consider an acoustic lever made from two cones, the driven side is constructed with a projected area of 200 cm.$^2$ and the radiating side is constructed with a projected area of 400 cm.$^2$. From the above equation it is shown that the radiated volume displacement will be twice that of the electro-acoustic transducers cone displacement. This means that the radiated volume velocity will also be twice that of the electro-acoustic transducer and that the Sound Pressure Level (SPL) resulting from this sound radiation will be increased by approximately 6 dB as a result of the presence of the acoustic lever.

The above derived relationship will not hold at all frequencies. At frequencies above the frequency of resonance defined by the volume of chamber 30 and the acoustic mass of lever 80 the amplification effect will disappear and the radiated sound will diminish. This roll-off can be made steeper, if desired, by making the connection between the radiating surface and driven surface of lever 80 flexible instead of rigid. The volume of chamber 30 and or the acoustic mass of lever 80 can be determined from this relationship and the desired upper frequency of operation.

Chamber 20 will act so as to decrease the compliance of the acoustic lever. The acoustic compliance of chamber 20 will add (in parallel) to the acoustic lever compliance to form a single lumped compliance for this component. In most designs this compliance is assumed to be high enough so that the resonance created by the lumped compliance of the acoustic lever and its physical mass is well below the operating bandwidth of the desired system. This can always be made to be the case by making the volume of chamber 20 larger, the acoustic mass of lever 80 larger and or by increasing the acoustic lever compliance. In practice the lumped acoustic lever will not effect the system performance to a large extent unless this lumped compliance becomes mall compared to the combined compliance of transducer 70 and chamber 40. In the event that the lumped acoustic lever compliance is not a sufficiently large compliance the result will be a de-tuning of the system, lowering its overall efficiency, primarily at the lower frequencies. This de-tuning can, to a certain extent, be compensated for by changes in the tuning of the other components of the system.

Physically the apparent acoustic compliance added by chamber 20 will be the normal acoustic compliance of this volume of air but acted upon by the acoustic lever as the difference in the projected areas of surfaces 81 and 85, since the two surfaces of the acoustic lever move in opposite directions relative to the volume between them.

The above equation for the net gain in acoustically radiated volume velocity predicts that the gain can be increased indefinitely by increasing acoustic lever surface ratio, the ratio of the driven area of the acoustic lever to its radiating area. The above discussion regarding the lumped acoustic lever compliance indicates that there will be a practical upper limit to this amplification. The apparent acoustic compliance of chamber 20 and the acoustic lever compliance will both decrease as one attempts to increase the acoustical gain by increasing the acoustic lever surface ratio. The lumped acoustic lever compliance will eventually become so small as to limit the effective gain at a rate faster than the gain is increased by increasing acoustic lever surface ratio.

Good results have been obtained for an acoustic lever whose radiating area is somewhat larger than that of the transducer and whose driven area is somewhat smaller than that of the transducer. A radiating area of about 1.4 times that of the transducer and a driven that is about 0.7 times that of the transducer will produce a volume velocity increase of two, and a theoretical improvement in the radiated pressure of six dB. These construction parameters result in an acoustic lever with surfaces that are not too different from that of the electro-acoustical transducer thus facilitating an easy construction while yielding an impressive six dB of increased output.

Referring now to FIG. 6 in detail, a chart is illustrated which shows the theoretical improvement in radiated pressure that is to be expected from my invention. This figure compares a standard bandpass tuning of the fourth order variety with a Q of about 0.7 (as described in my paper "An Introduction to Bandpass Loudspeaker Systems")(lower curve) with an enclosure system utilizing an acoustic lever (upper curve). The transducer and enclosure volumes in this figure have been held constant. The specific design of the acoustic lever shown in FIG. 5 operates in a bandpass mode wherein the acoustic mass of lever 80 and the volume of the chamber 30 are adjusted so as to resonant at the resonance frequency of transducer 70 when placed in chamber 40. The acoustic mass of the lever is made to be 1.414 times the acoustic mass of the transducer. This alignment is identical to that discussed in my paper above except that here the lumped acoustical lever has been ignored. This is valid so long as this compliance is not too small, as described above. The acoustic mass of the acoustic lever is its moving mass divided by its radiating area In general, all of the designs described in my "Bandpass" paper are applicable here wherein substantial improvements in output can be obtained through the use of acoustic levers as opposed to the "ports" described in that paper. This is true as long as the lumped acoustic lever compliance is not too small as described above.

Referring now to FIG. 7 in detail, a perspective drawing is shown which highlights an alternate form of my invention. Dual acoustic lever system enclosure 100 is partitioned into front acoustic lever to electro-acoustic transducer coupling chamber 110, rear acoustic lever to electro-acoustic transducer coupling chamber 120 and acoustic lever chamber 130 by interior acoustic lever partition 140 and electro-acoustic transducer partition 50. Front acoustic lever 150 is coupled to the front of transducer 70 through chamber 110. Rear acoustic lever 160 is coupled to the rear of transducer 70 through chamber 120. An acoustic lever separating partition 145 in chamber 130 may be required to avoid interference between levers 150 and 160. This partition is not shown in the perspective view but is shown in the cross sectional view of FIG. 8. In this manner both radiating sides of transducer 70 can be utilized for an even greater increase in radiated output.

Determining the correct volumes of chambers 110 and 120 and the correct acoustic masses for the levers 160 and 150 would follow along analogous lines to the design of a six order non-symmetric bandpass enclosure described in my paper "An Introduction to Bandpass Enclosure Designs". This is true as long as the lumped acoustic lever compliance is not too small, as described above.

In some applications it may be undesirable, due to phase interference effects, to use two acoustic levers. This problem can be circumvented by using an acoustic duct, 170, essentially a hollow tube of standard construction, often used in "ported" loudspeaker enclosures, as the acoustical mass in the lower frequency box resonance tuning. When this is done an improved pass band efficiency can be obtained without the degradation in the low frequency output which will result from phase interference if two acoustical levers are used. This construction is shown in FIG. 9.

In any of the designs disclosed here the effective acoustic lever can be made up of several acoustic levers. In this case the sum of the acoustic masses of the individual levers would yield a single effective acoustic mass to be used in the design. These multiple levers would facilitate alternate constructions and polar responses for the system and reflect yet another design degree of freedom.

In my invention it should be noted that the fluid medium acting between the transducer and the acoustic lever can be any fluid substance including air, a gas or a liquid. In some applications the use of liquid as the coupling medium will be advantageous due to its incompressible nature. This would allow for a much wider bandwidth of the device than would otherwise be possible if a more compressible fluid, such as air, were used. This feature would be useful, for example, in an application where it is impractical to use more than a single transducer because of space issues. Examples of this type of application are hearing aid transducers and earphone transducers.

It is a further feature of my invention that the acoustic distortion of the system would be lowered. It is a well known effect of nonlinear distortion in transducers that a non-symmetric nonlinearity will cause the diaphragm to exhibit a static displacement, thus moving the cone into regions of even higher non-linearity. This static force is opposed by the system stiffness seen by the transducer at zero frequency. In a transducer system with air as the acoustic mass, such as ports, the zero frequency stiffness of the system is simply that of the transducer diaphragm support. When an acoustic lever is used the zero frequency stiffness opposing the static force is substantially higher due to the stiffness of the acoustic lever. Thus the diaphragm will not displace as much from the static force and the net distortion of the system will be lowered.

Other novel and unique modifications to the above description will be evident to those proficient in the art.

In the vein of the pure acoustical implementation of a bandpass system there are several patents on numerous configurations of ducts and enclosures all aimed at improved efficiency. Each of these acoustical implementations suffer from the efficiency—bandwidth tradeoff described above. While some are very efficient in terms of output and construction it would still be desirable to improve on these designs in a manner which does not degrade the bandwidth and is yet easy to construct.

SUMMARY OF THE INVENTION

The present invention provides for a novel use of an "acoustic lever". Both Dusanek and Clarke used acoustic levers in their inventions, although they did not call them as such and they were used in different configurations than in the invention disclosed here.

An acoustic lever, see FIG.(3), which shows several embodiments, is a passive mechanical device constructed of two rigid diaphragms (14, 16) mechanically connected together and compliantly supported in a manner so as to allow motion along a line (18) The line of motion is normal to two baffles (11, 12) into which the compliantly supported diaphragms have been installed. It should be noted that the baffles need not be flat planes as shown in the drawing, although this is the easiest and most logical form for these baffles. It would be obvious, to one skilled in the art, how to define and construct an acoustic lever for non-planar baffles. Effective surface areas of the diaphragms are defined as the projection of the diaphragm surfaces onto a plane normal to the axis of motion. These surfaces have areas denoted as the driven area $A_{ld}$ and the radiating area $A_{lr}$. In one embodiment of an acoustic lever, flat circular diagrams are connected together by a rigid rod as shown in FIG.(3A). The rod need not-be perfectly rigid however, and one skilled in the art could see how this would effect the systems performance.

In another embodiment one or both of the diaphragm members can be a section of a cone, like a passive radiator diaphragm. When two cones are used they are placed apex to apex and fastened together as shown in FIG.(3B). There are no holes within an acoustic lever through which air can pass, i.e. through the apex's of the cone sections.

In another embodiment the apex of the cone section can be attached to a round plate (the driven diaphragm as shown in FIG.(3C).

The defining characteristic of an acoustic level is that it always has three distinct surfaces and is installed between two baffles. The acoustic lever surfaces are; a radiating surface which lies in that side of one of the baffles that does not oppose the other baffle; a driven surface which lies in that side of the other baffle which does not opposed the other baffle; and an inner surface that is composed of those surfaces which move and that lie between the two baffles. The area of the driven surface is generally smaller than the radiating area. The radiating area, in the context of this invention always faces the exterior of the enclosure and the driven surface is always located on an interior baffle. The inner surface always has an effective area which is the difference of the driven and radiating areas. When two passive radiators are connected together to form an acoustic lever, FIG.(3B) one of the surfaces of each of the passive radiators is combined with one of the surfaces of the other passive radiators to form the inner surface of the acoustic lever. If the driven area and the radiating area of an acoustic lever are equal then the inner area becomes zero and the acoustic lever is in essence a passive radiator. Thus a passive radiator is a special case of an acoustic lever, which is of no interest in this invention.

When an acoustic lever is acoustically coupled to a electro-acoustic transducer in a manner which forces all radiated sound to go through the acoustic lever, i.e. acoustically in series, then the resulting system can be made to cause a many-fold increase in the radiated volume velocity of the transducer, throughout the operating pass band of the system. This results in a significant increase in the efficiency of the transducer enclosure combination when compared to the same transducer used without the lever.

A novel transducer enclosure can also be assembled by utilizing two acoustic levers, one on each side of the electro-acoustic transducer which will further enhance the radiated sound output of this design. One of the levers can be replaced by a standard duct or passive radiator system for even more design flexibility.

The acoustic lever enclosure design will also lower the distortion radiated from the transducer.

Figure 1:
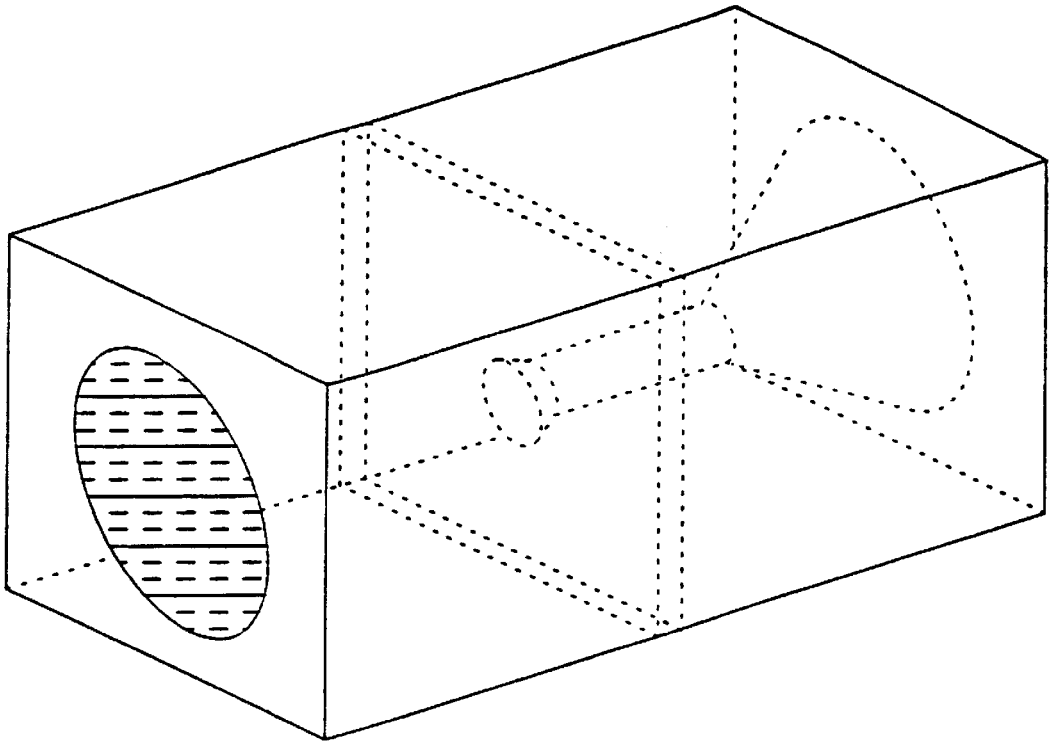
FIG. 1 shows a drawing of the preferred embodiment of the prior art of Dusanek.
Figure 2:
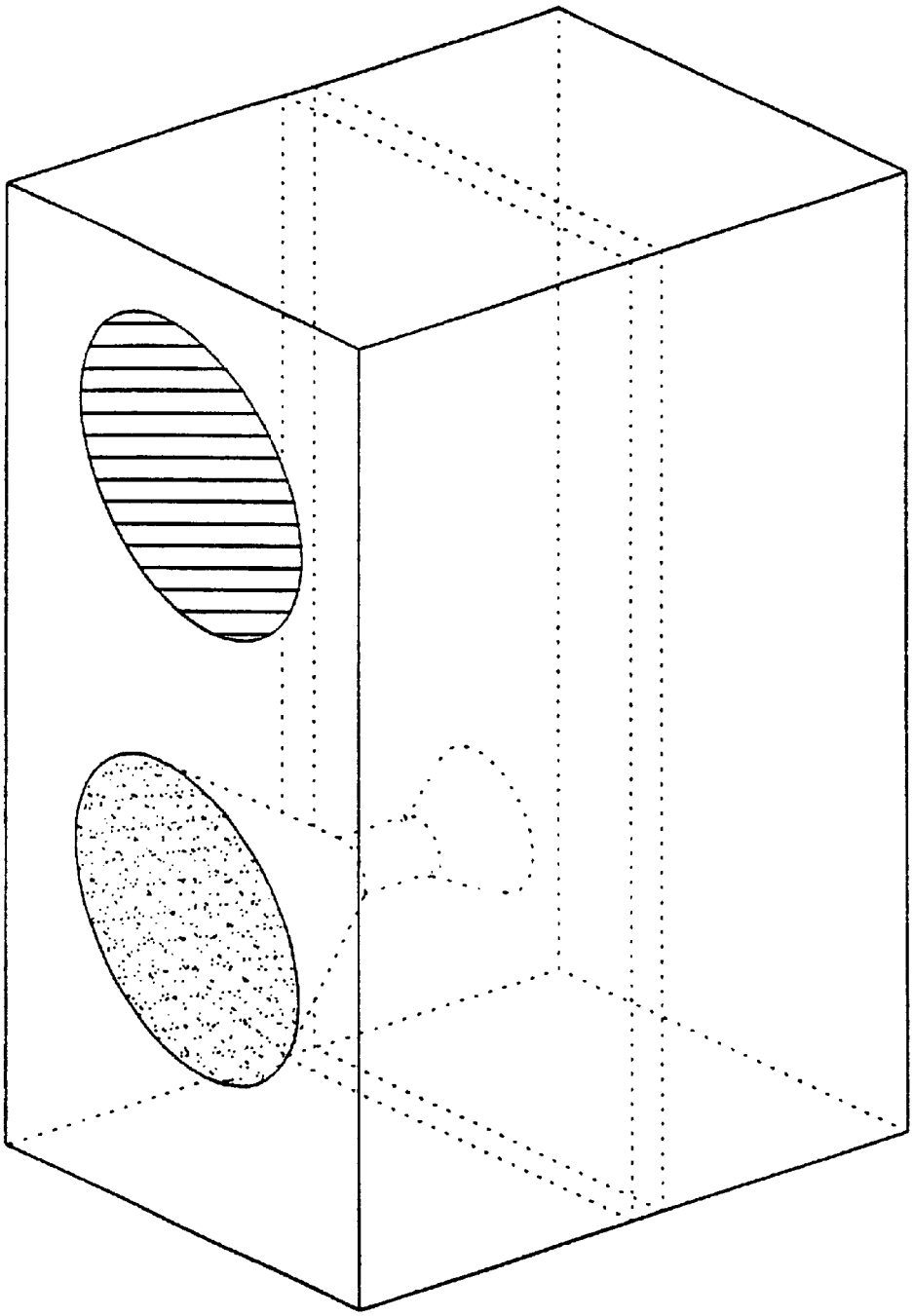
FIG. 2 shows a drawing of the preferred embodiment of the prior art of Clarke.
Figure 3:
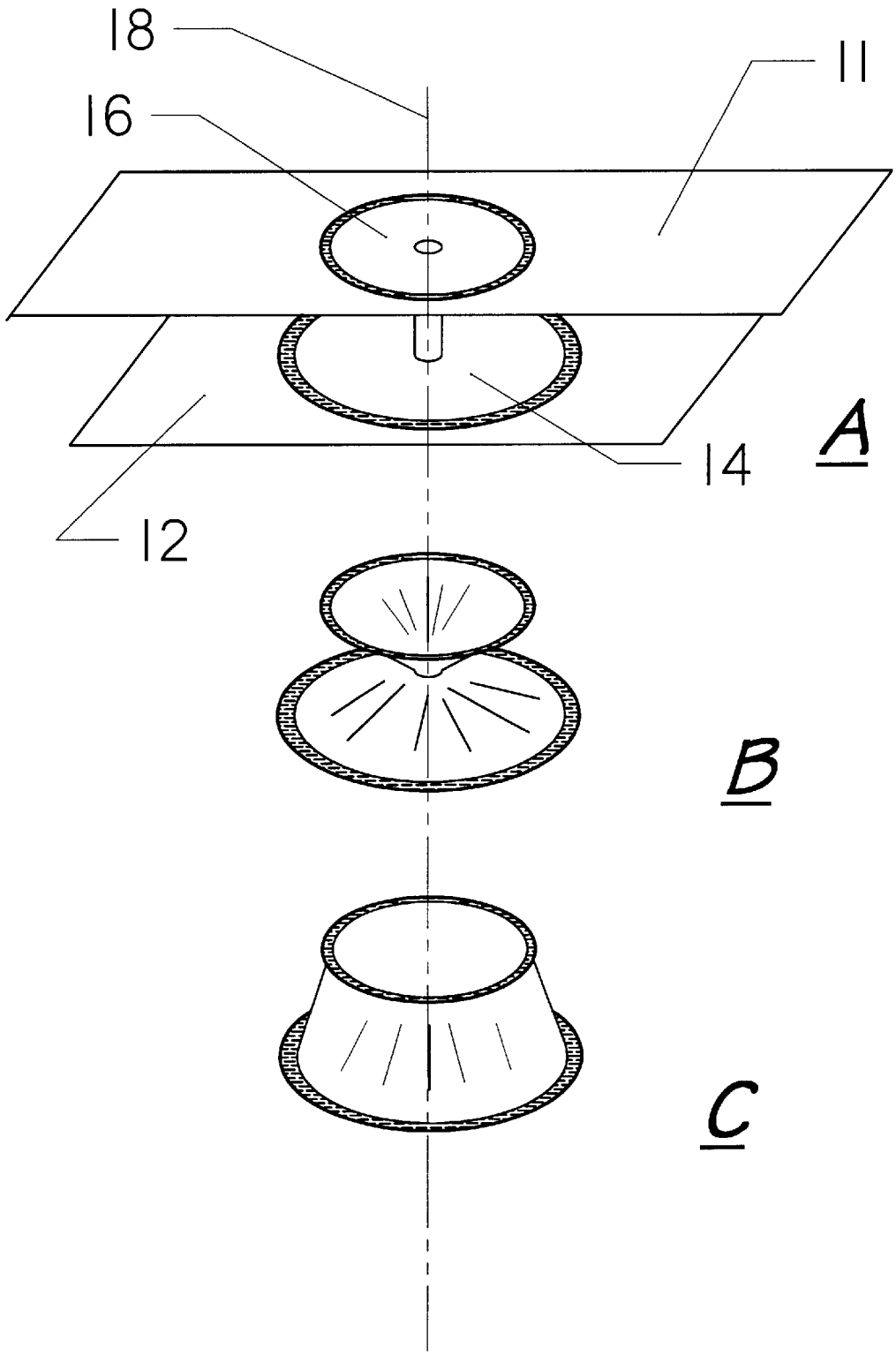
FIG. 3 is a perspective view of three possible acoustic lever implementations, in A the baffles are explicitly shown.

| Reference Numerals in Drawings | |
|---|---|
| 10 | system enclosure |
| 11 | baffle containing driven diaphragm |
| 12 | baffle containing radiating diaphragm |
| 14 | acoustic lever driven compliantly supported diaphragm |
| 16 | acoustic lever radiating compliantly supported diaphragm (underside) |
| 18 | axis of motion |
| 20 | acoustic lever chamber |
| 30 | acoustic lever to electro-acoustic transducer coupling chamber |
| 40 | electro-acoustic transducer rear chamber volume |
| 50 | electro-acoustic transducer partition |
| 60 | interior acoustic lever partition |
| 70 | electro-acoustic transducer |
| 80 | acoustic lever |
| 81 | acoustic lever radiating surface |
| 82 | acoustic lever radiating surface compliant support |
| 85 | acoustic lever driven surface |
| 86 | acoustic lever driven surface compliant support |
| 95 | electro-acoustic transducer energizing wires |
| 100 | dual acoustic lever enclosure |
| 110 | front acoustic lever to electro-acoustic transducer coupling chamber |
| 120 | rear acoustic lever to electro-acoustic transducer coupling chamber |
| 130 | acoustic lever chamber |
| 140 | interior acoustic lever partition |
| 145 | dual acoustic lever isolation baffle |
| 150 | front acoustic lever |
| 160 | rear acoustic lever |
| 170 | acoustical duct |

DESCRIPTION OF THE PREFERRED EMBODIMENT

Figure 4:
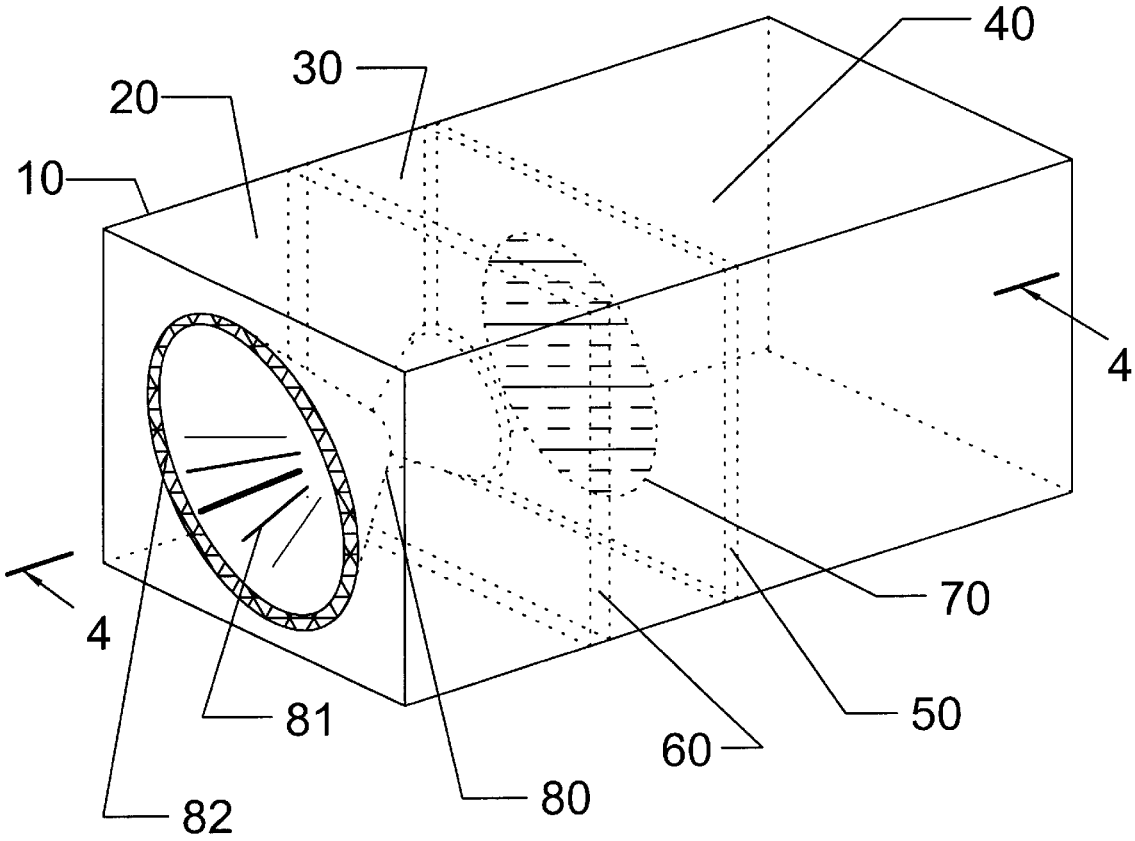
FIG. 4 is a perspective view of the novel enclosure utilizing a single acoustic lever.
Figure 5:
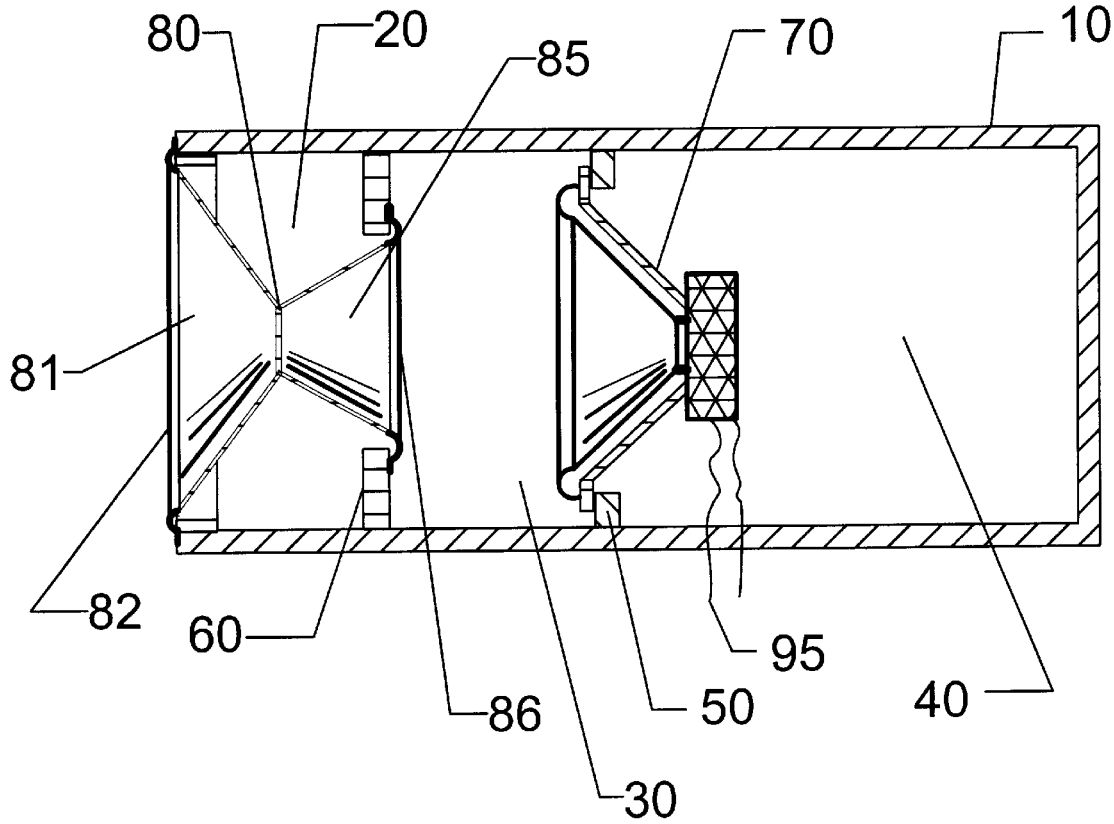
FIG. 5 is a cross sectional view of the transducer enclosure shown in FIG. 3 as taken in the direction of 2—2 thereof.
Figure 6:
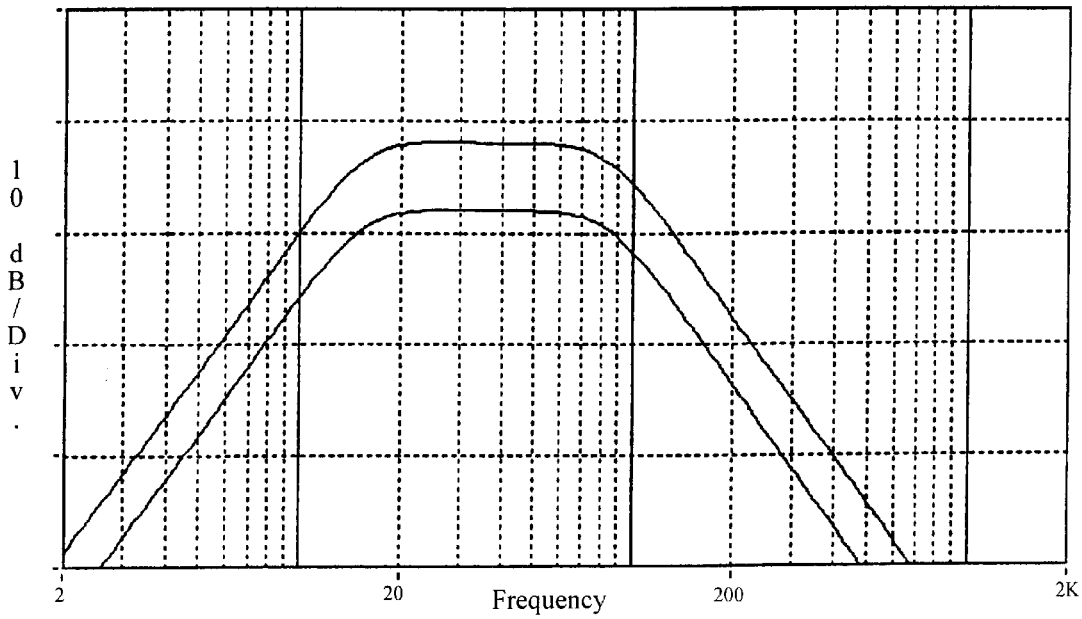
FIG. 6 shows a frequency response comparison of a standard bandpass enclosure design and the novel design incorporating an acoustic lever.
Figure 7:
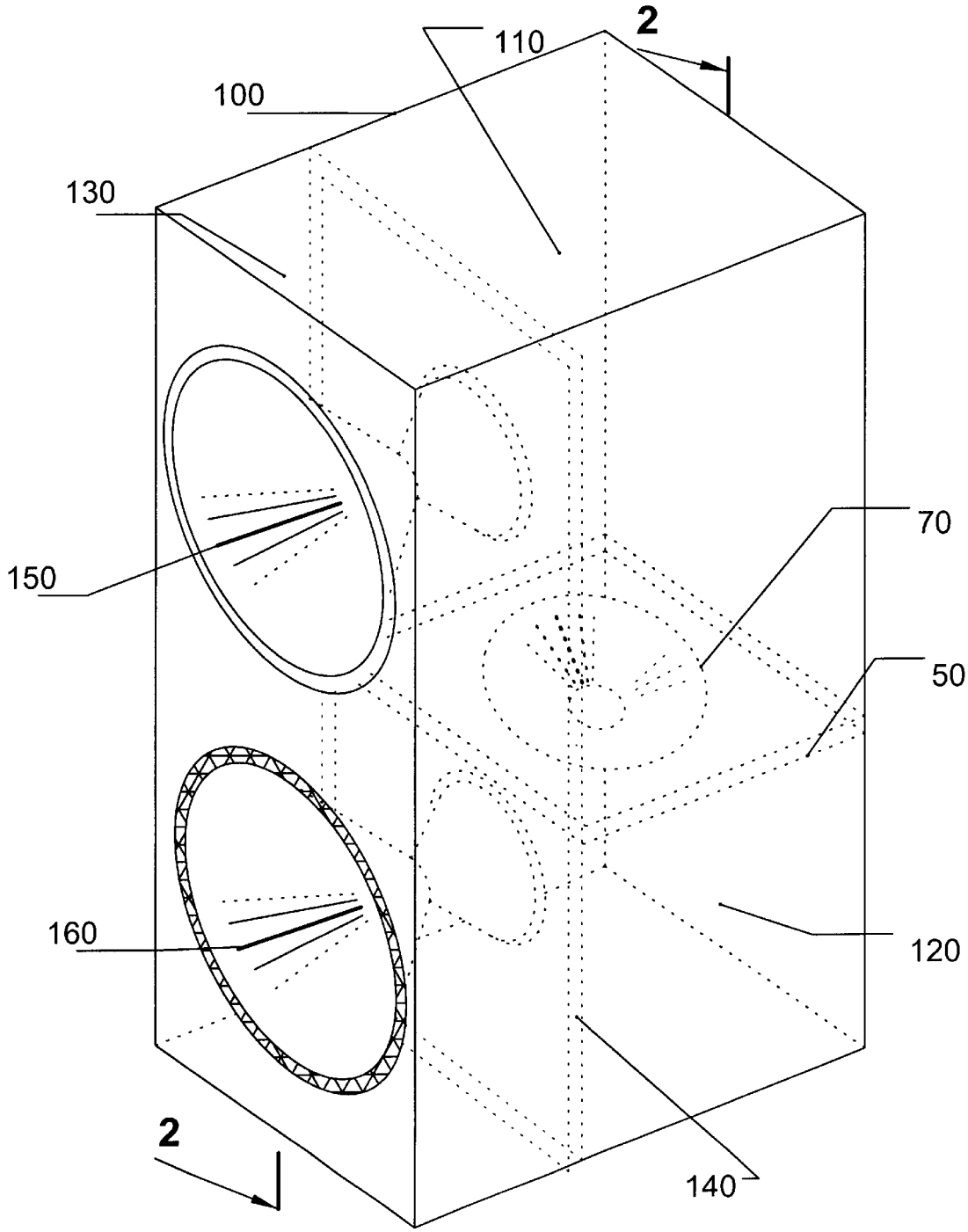
FIG. 7 shows a perspective view of the novel enclosure design which incorporates two acoustic levers.
Figure 8:
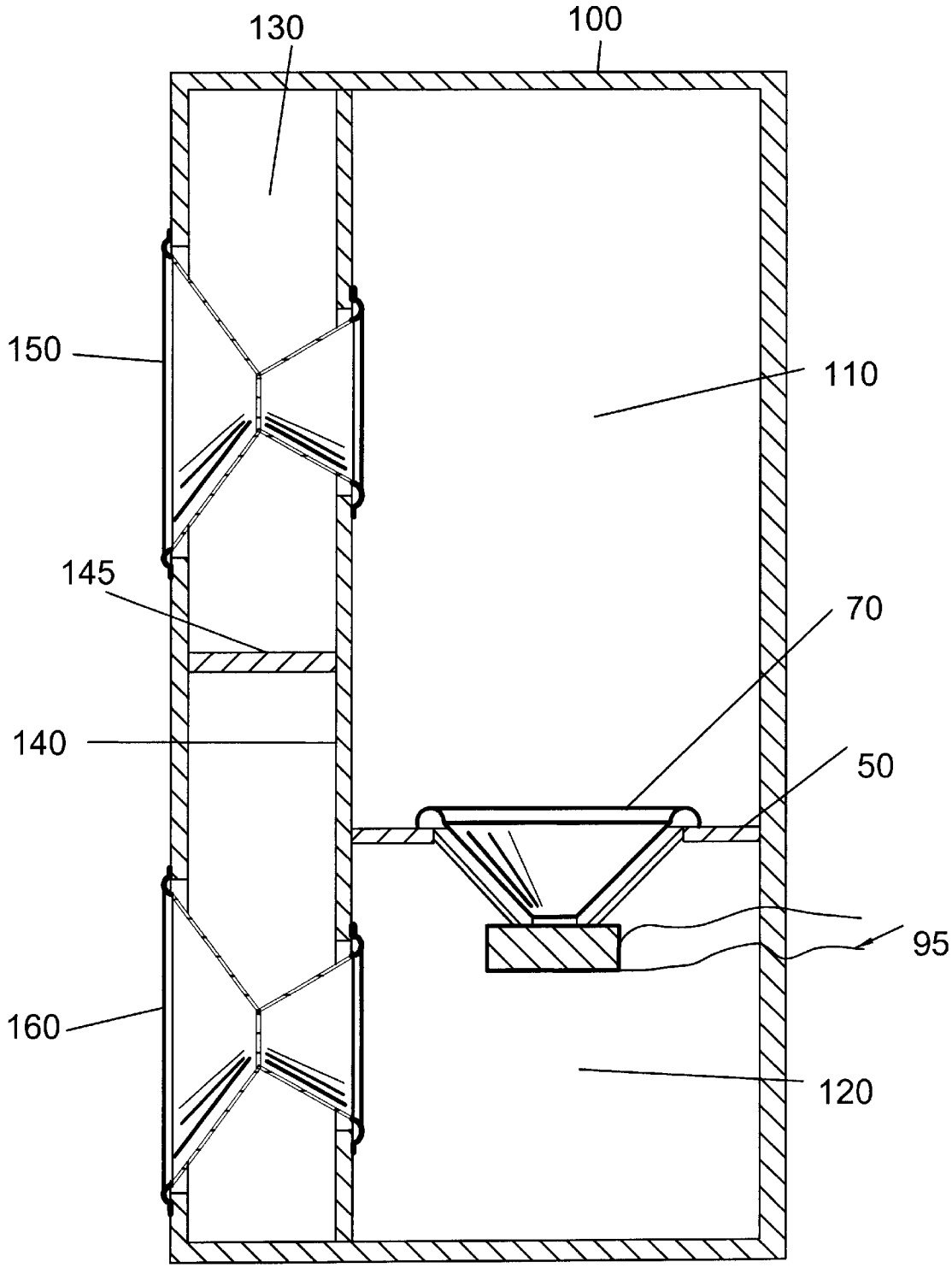
FIG. 8 shows a cross sectional view of the transducer enclosure shown in FIG. 6 as taken in the direction of 3—3 thereof.
Figure 9:
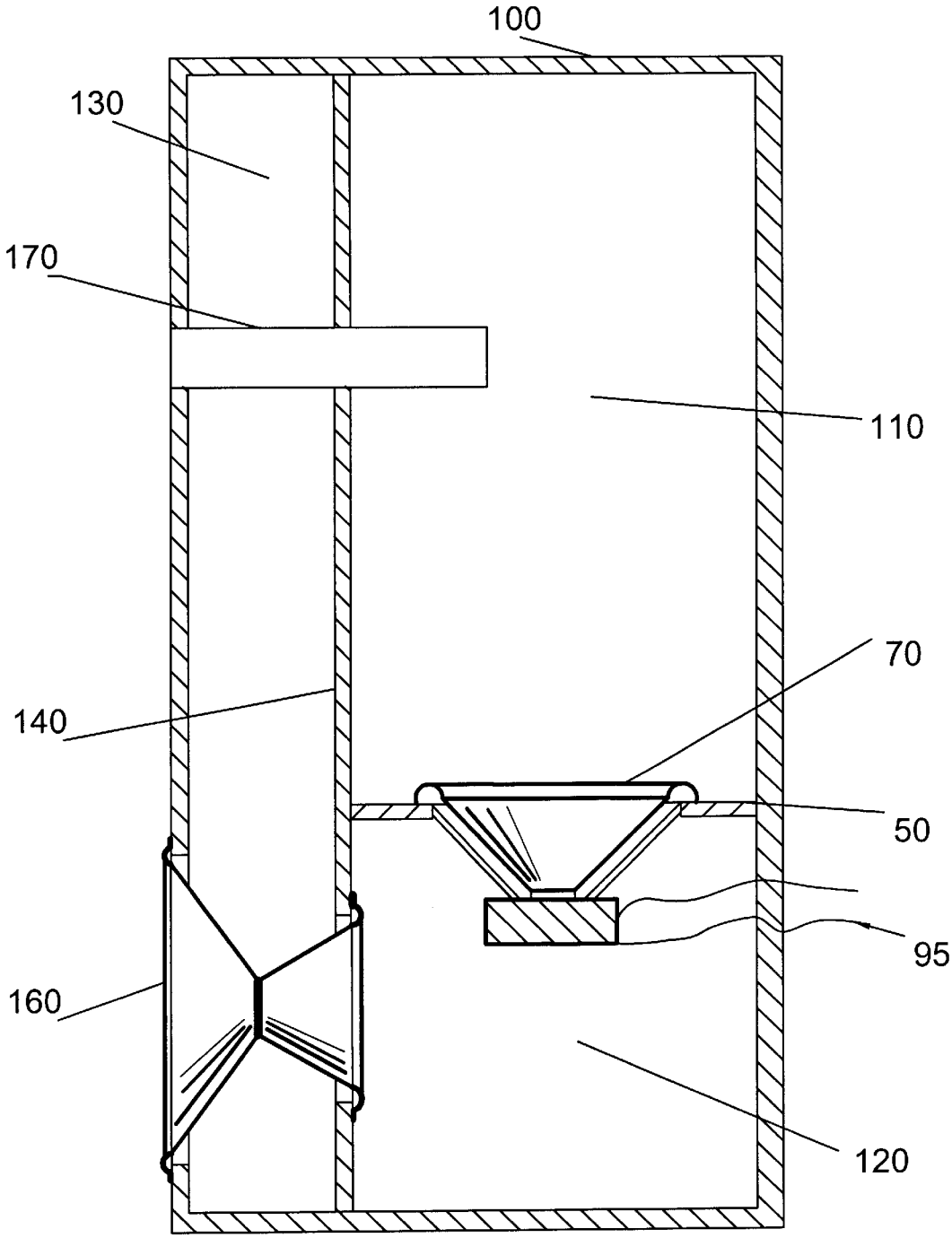
FIG. 9 shows a cross sectional view of a transducer enclosure with the front chamber (low frequency tuning) acoustical mass implemented with a duct.

A preferred embodiment of the enclosure is illustrated in FIGS. 4 and 5. An external enclosure 10 is subdivided into at least three internal chambers; a acoustic lever chamber 20, an acoustic lever to electro-acoustic transducer coupling chamber 30 and a rigid closed electro-acoustic transducer rear chamber 40 by electro-acoustic transducer partition 50 and an interior acoustic lever partition 60. The enclosure and the internal partitions are of standard construction. An electro-acoustic transducer 70, of standard construction, is securely attached to partition 50 and sealed so that negligible air flow exists between chamber 40 and chamber 70.

An acoustic lever 80 is mounted such that it has its radiating surface 81 along with its compliant surround 82 are sealingly mounted in one exterior wall of enclosure 10 and its driven surface 85 along with its compliant surround 86 are sealingly mounted on partition 60. The two compliant surrounds, 82 and 86 will act together to create a single acoustic lever compliance.

I claim:

1. An enclosure for housing an acoustic transducer comprising:

an external rigid shell with first and second interior baffles partitioning the interior of said enclosure into three chambers;

at least one active acoustic transducer mounted on said first interior baffle, and;

at least one passive acoustic lever, comprising;

two passive radiators, of different areas, which are mechanically joined together so as to move as a single unit, connected between one of said first and second interior baffles and said external rigid shell.

2. An enclosure for housing an acoustic transducer as in claim 1 wherein:

said passive acoustic lever is connected between said second interior baffle and said external rigid shell.

3. An enclosure for housing an acoustic transducer as in claim 1 including:

at least one port which contains an acoustic duct or passive radiator, on said interior baffles.

4. An enclosure for housing an acoustic transducer of claim 1 including:

at least one port which contains an acoustic duct or passive radiator, on said external rigid shell.

5. An enclosure for housing an acoustic transducer comprising:

an external rigid shell with first and second interior baffles partitioning the interior of said enclosure into chambers one, two and three;

at least one acoustic transducer mounted on said first interior baffle between said chambers one and two; and at least two passive acoustic levers, one and two, each acoustic lever comprising two passive radiators, of different areas, which are mechanically joined so as to move as a single unit, connected between said first or second interior baffles and said external rigid shell.

6. An enclosure for housing an acoustic transducer as in claim 5 wherein:

said passive acoustic lever one is connected between said second interior baffle and said external rigid shell.

7. An enclosure for housing an acoustic transducer as in claim 6 wherein:

said passive acoustic lever two is connected between said second interior baffle and said external rigid shell.

8. An enclosure for housing an acoustic transducer as in claim 5 including:

an additional interior baffle partitioning said interior chamber three such that said acoustic levers one and two are each in their own chamber.

* * * * *